US011060297B2

(12) United States Patent
Erickson

(10) Patent No.: US 11,060,297 B2
(45) Date of Patent: Jul. 13, 2021

(54) STAIR SYSTEM

(71) Applicant: Russell Erickson, Blaine, MN (US)

(72) Inventor: Russell Erickson, Blaine, MN (US)

( * ) Notice: Subject to any disclaimer, the term of this patent is extended or adjusted under 35 U.S.C. 154(b) by 0 days.

(21) Appl. No.: 16/705,571

(22) Filed: Dec. 6, 2019

(65) Prior Publication Data

US 2020/0181920 A1 Jun. 11, 2020

Related U.S. Application Data

(60) Provisional application No. 62/776,843, filed on Dec. 7, 2018.

(51) Int. Cl.
*E04F 11/02* (2006.01)
*E04F 11/025* (2006.01)

(52) U.S. Cl.
CPC ..... *E04F 11/0255* (2013.01)

(58) Field of Classification Search
CPC .. E04F 11/0209; E04F 11/025; E04F 11/0255
See application file for complete search history.

(56) References Cited

U.S. PATENT DOCUMENTS 3,962,838 A * 6/1976 Cox ..... E04F 11/0255 52/183
7,946,085 B2 * 5/2011 Prins ..... E04F 11/025 52/191
2003/0208971 A1 * 11/2003 Couture ..... E04F 11/0255 52/182

* cited by examiner

*Primary Examiner* — Patrick J Maestri
(74) *Attorney, Agent, or Firm* — Vidas Arrett & Steinkraus P.A.

(57) ABSTRACT

The stair system is made of a deck plate attached to an existing structure (such as a deck) and to the top end of a pair of stringer beams. A base plate is attached to the bottom end of the pair of stringer beams. Next a plurality of steps are attached to the pair of stringer beams, the steps being comprised of a tread assembly, a pair of tread brackets and at least one intermediate support bracket. The steps can be integrally formed or made of modular components which are connected together to form the step. Finally, the decking material is attached to the step.

8 Claims, 13 Drawing Sheets

STAIR SYSTEM

CROSS-REFERENCE TO RELATED APPLICATIONS

This Application claims the benefit of and priority to U.S. Provisional Application No. 62/776,843, filed Dec. 7, 2018, the entire contents of which is hereby incorporated by reference.

STATEMENT REGARDING FEDERALLY SPONSORED RESEARCH

Not Applicable.

BACKGROUND OF THE INVENTION

Stairs are currently built manually, which requires lots of parts and labor. There is a need for a modular component system to quickly and easily create stairs for outdoor decks, patios, porches or similar structures. It allows for quick assembly, minimizing the number of cuts to materials that need to be made and reducing the number of attachment hardware i.e. bolts, screws etc. This greatly increases efficiency and reduces labor. The system also allows for easy adjustment of stair height without needing to recut support beams.

Without limiting the scope of the invention a brief summary of some of the claimed embodiments of the invention is set forth below. Additional details of the summarized embodiments of the invention and/or additional embodiments of the invention may be found in the Detailed Description of the Invention, below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The invention provides a system and method of making a stair system. The stair system is made of a deck plate attached to an existing structure (such as a deck) and to the top end of a pair of stringer beams. A base plate is attached to the bottom end of the pair of stringer beams. Next a plurality of steps are attached to the pair of stringer beams, the steps being comprised of a tread assembly, a pair of tread brackets and at least one intermediate support bracket. The steps can be integrally formed or made of modular components which are connected together to form the step. Finally, the decking material is attached to the step. The components of the stair system are made of metal, but could be made of any desired material.

DETAILED DESCRIPTION OF THE INVENTION

Figure 1:
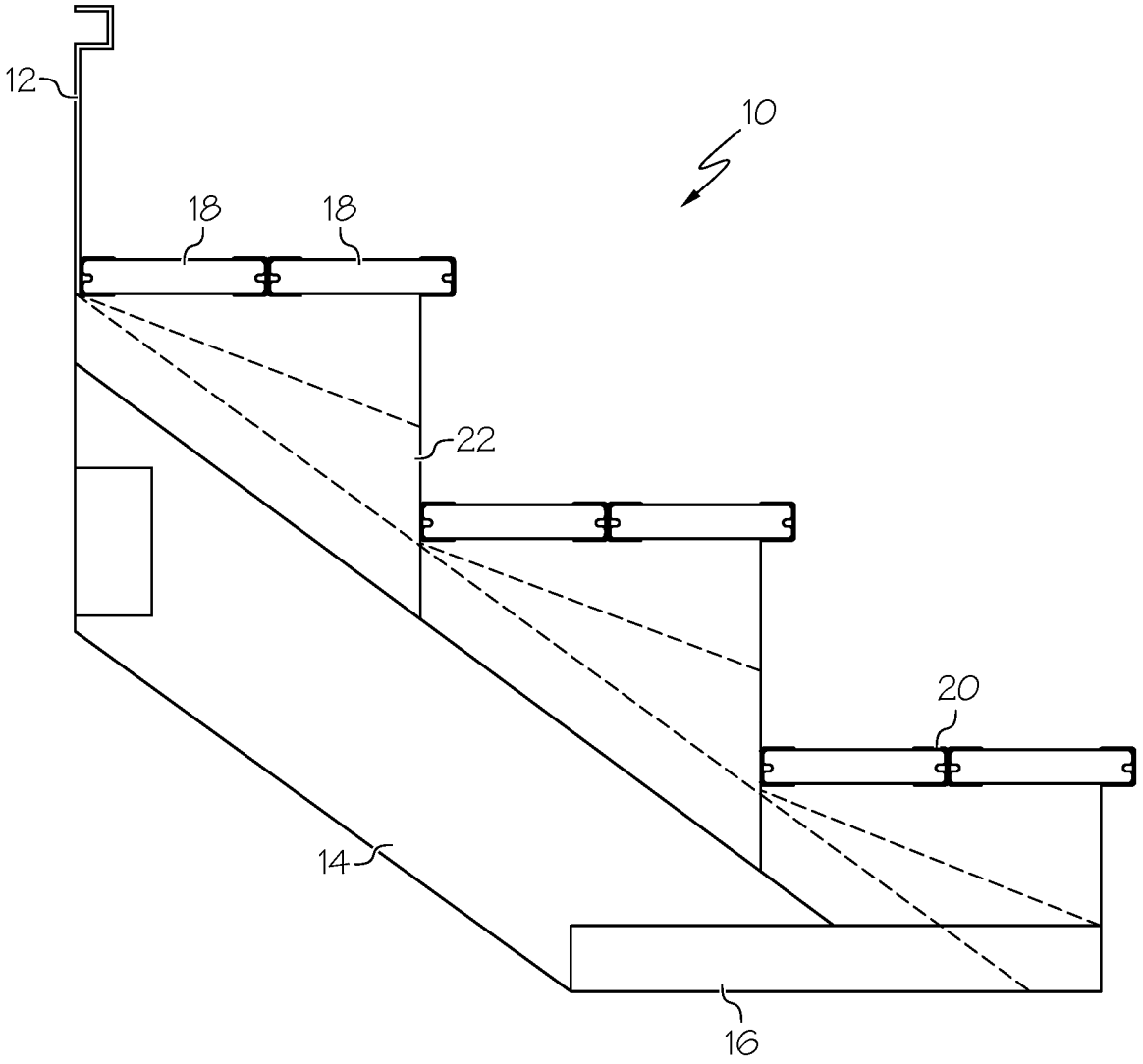
FIG. 1 shows a side view of the inventive stair system.

Referring now to FIG. 1, the inventive stair system is shown generally at 10. The stair system is a modular component system that allows for the quick and easy creation of outdoor stairs for decks, patios, porches or similar structures. It includes hardware for attachment to the main structure (for example a deck, which is not shown), a base plate and components for individual stair assemblies that can be put together onsite of in advance of the project. Because the stair assemblies are modular you are able to adjust height allowing for a more customizable approach to building stairs.

The stair system reduces the amount of measurements, cuts and hardware i.e. bolts, screws etc. needed for stair creation reducing overhead and labor costs. You are also able to choose any decking material you like for a fully unique aesthetic.

Figure 2:
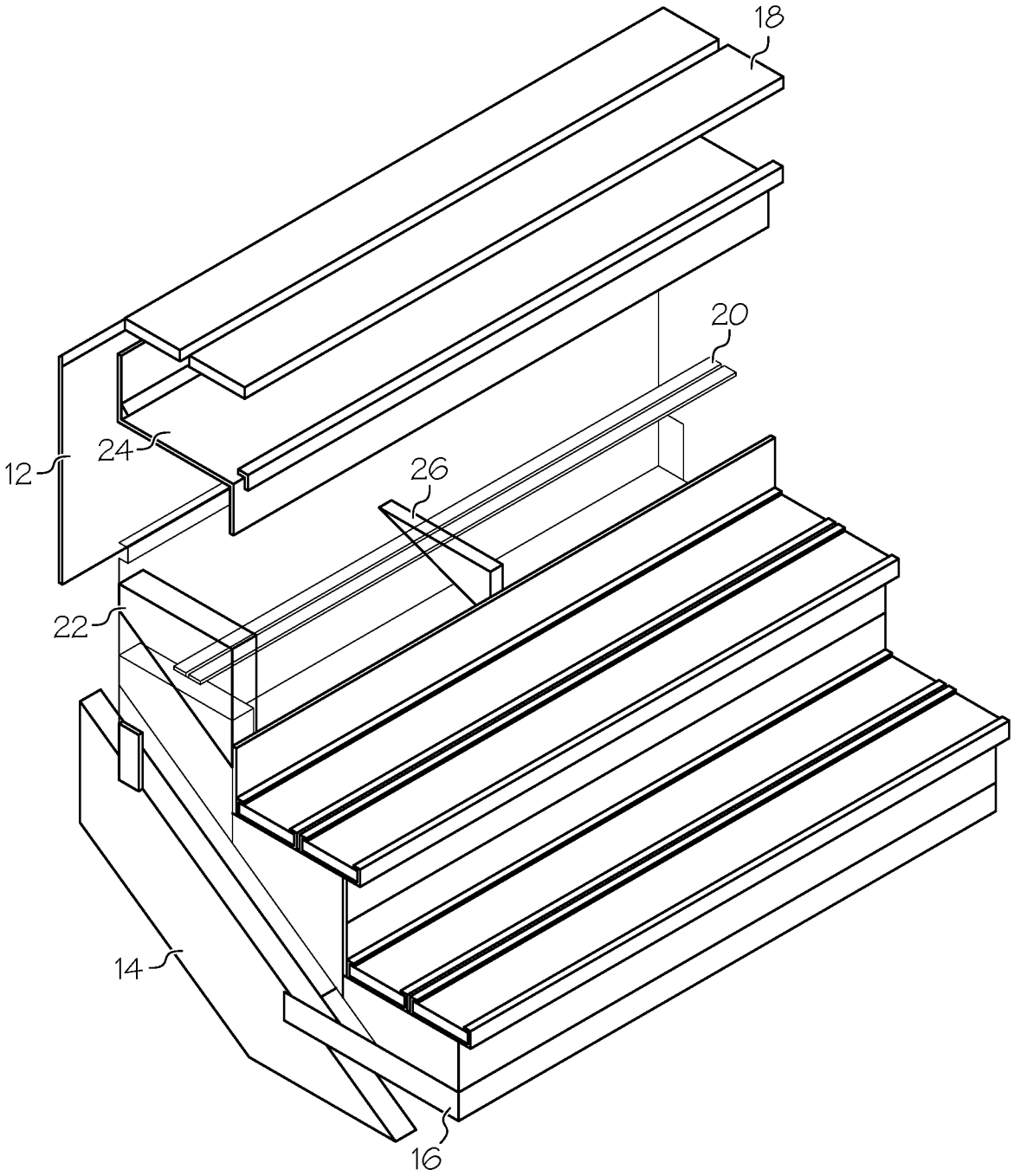
FIG. 2 shows an exploded view of the parts of the inventive stair system.
Figure 3:
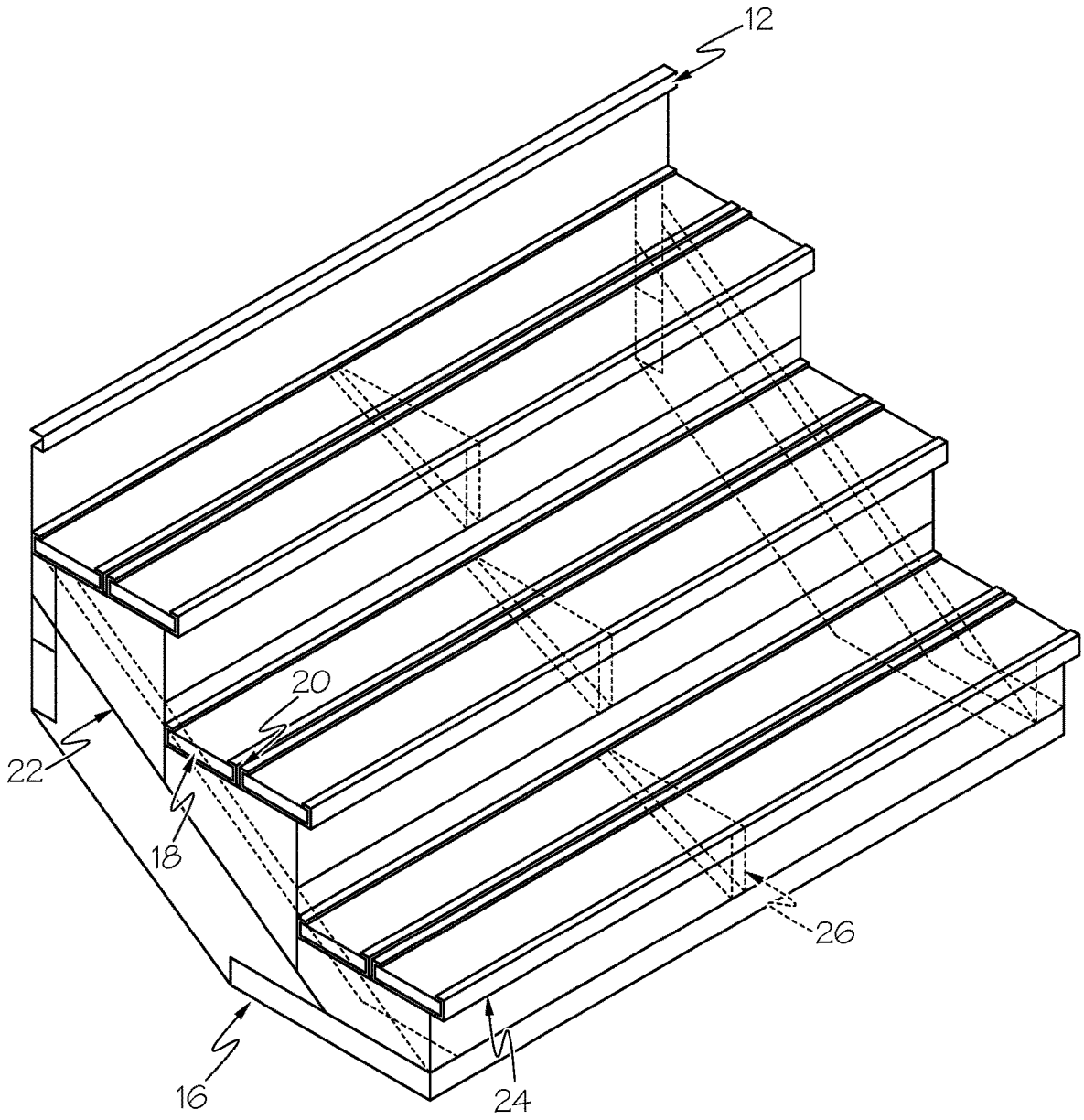
FIG. 3 shows a view of the parts of the inventive stair system with parts shown in silhouette.
Figure 4:
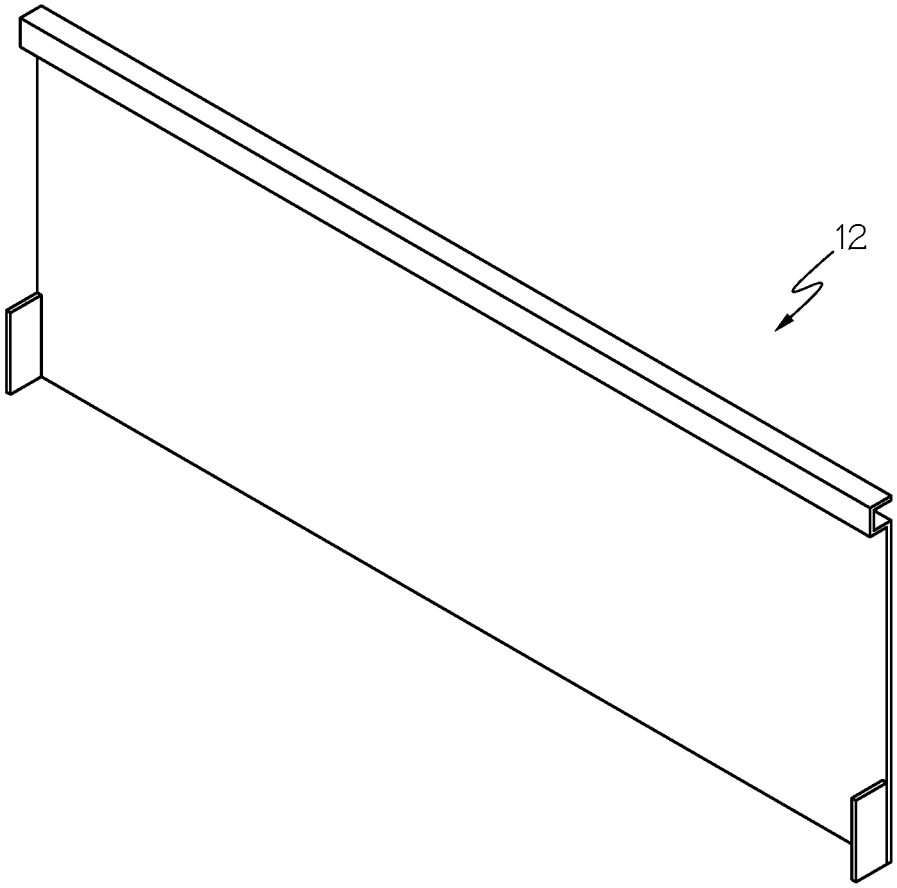
FIG. 4 shows the deck mounting plate.
Figure 5:
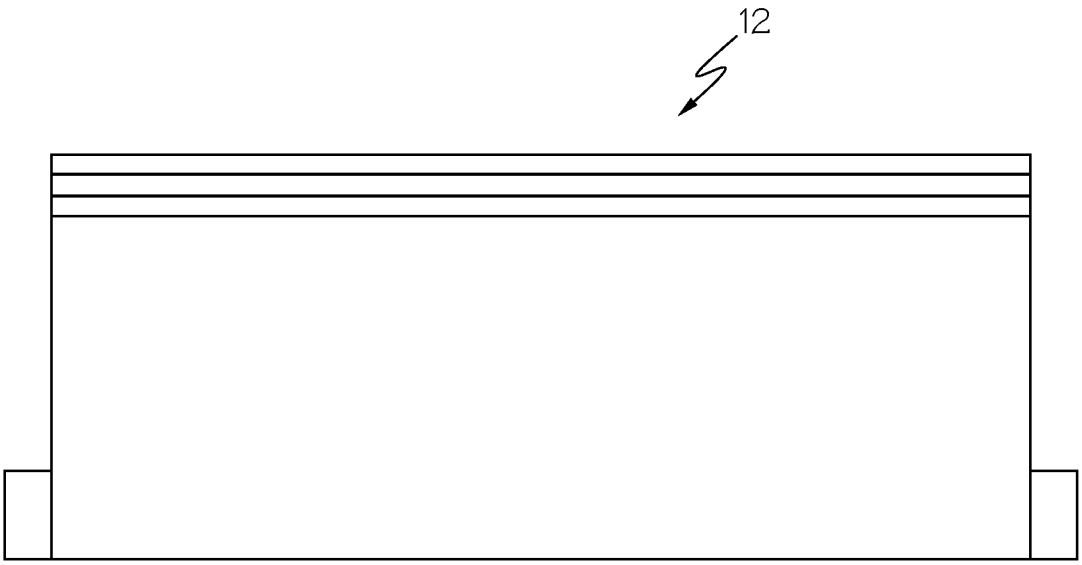
FIG. 5 shows the bend lines to fold a piece of extruded aluminum to form the deck mounting plate.
Figure 6:
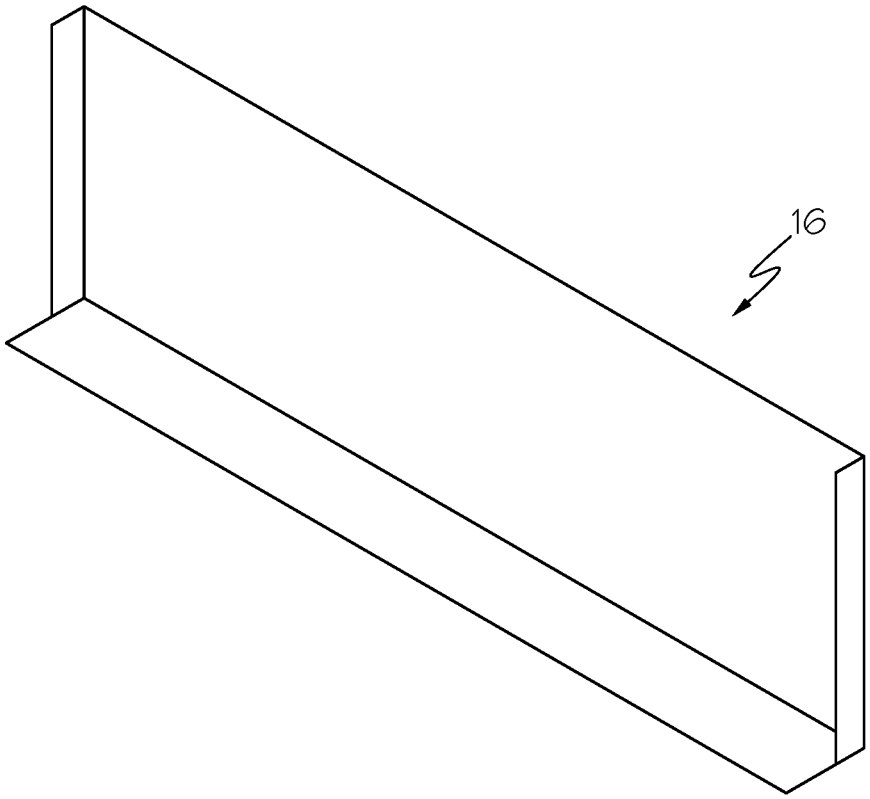
FIG. 6 shows the base plate.
Figure 7:
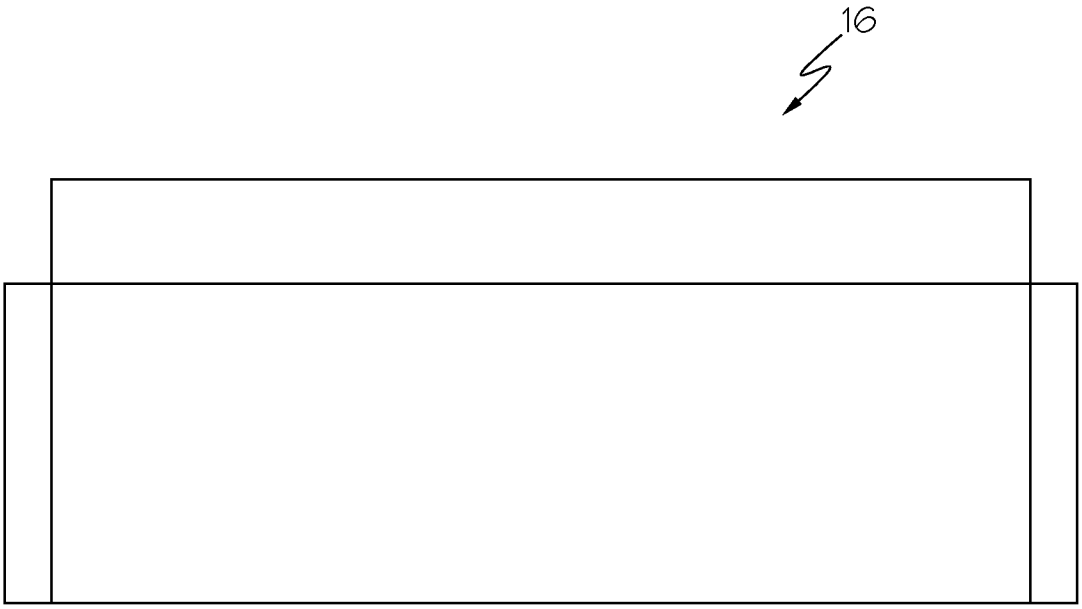
FIG. 7 shows the bend lines to fold a piece of extruded aluminum to form the base plate.
Figure 8:
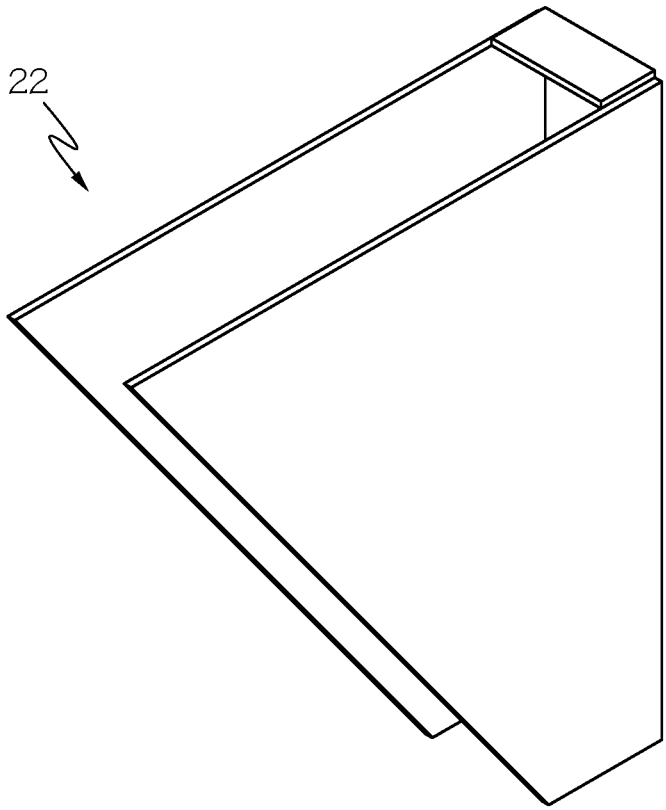
FIG. 8 shows the tread bracket.
Figure 9:
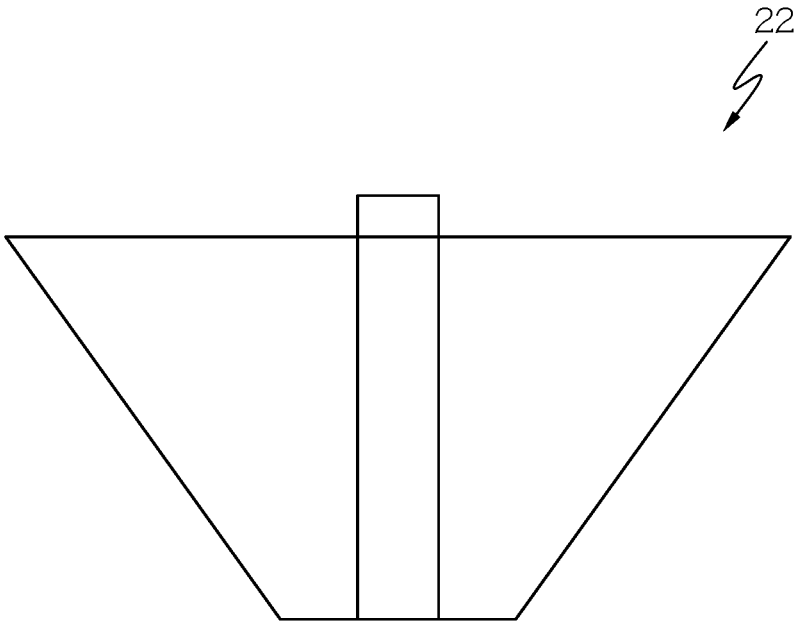
FIG. 9 shows the bend lines to fold a piece of extruded aluminum to form the tread bracket.
Figure 10:
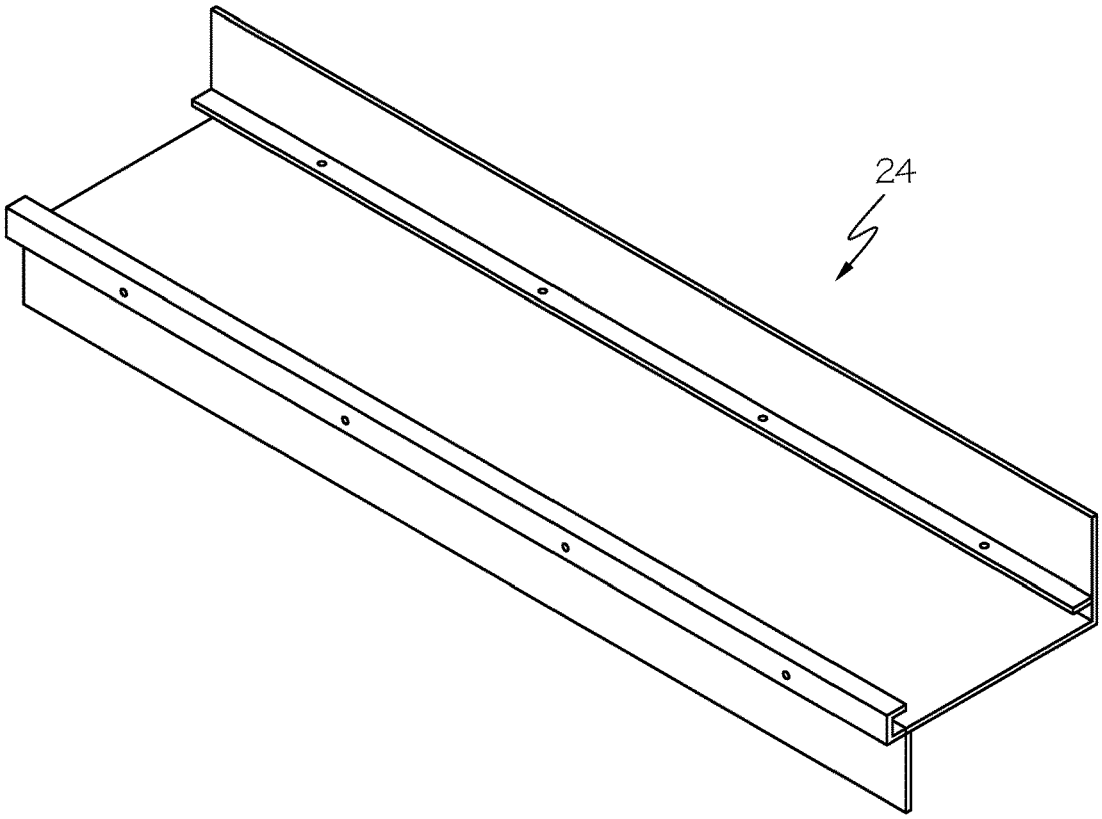
FIG. 10 shows the tread assembly.
Figure 11A:
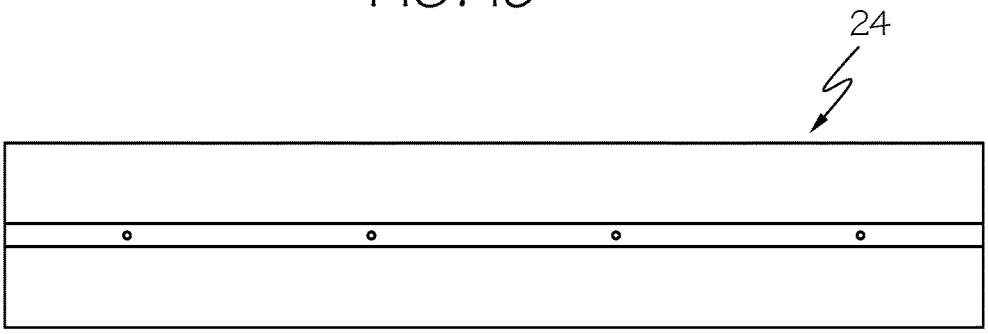
FIG. 11 shows the bend lines to fold a piece of extruded aluminum to form the tread assembly.
Figure 11B:
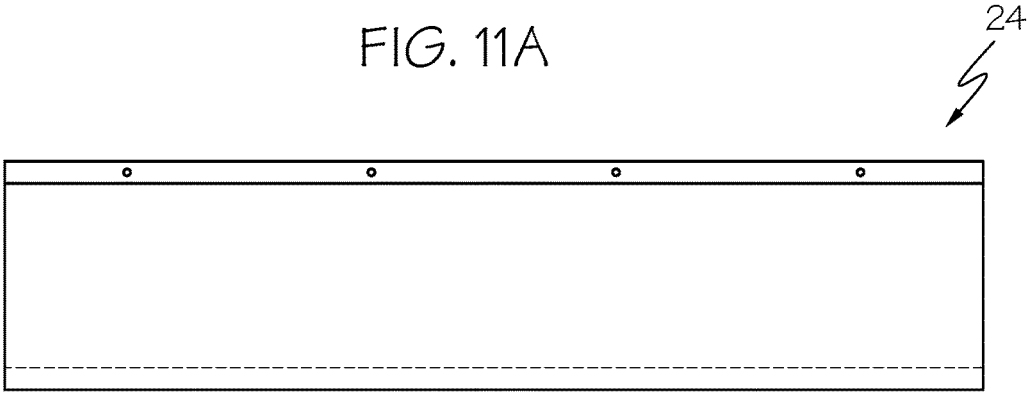
Figure 12:
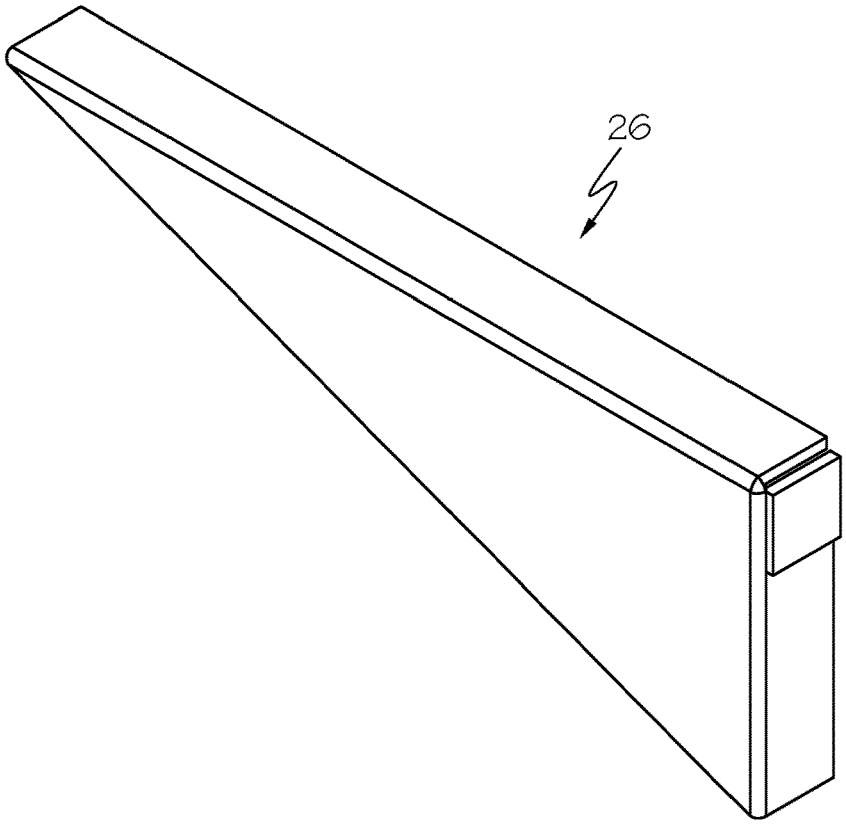
FIG. 12 shows an intermediate support bracket.
Figure 13:
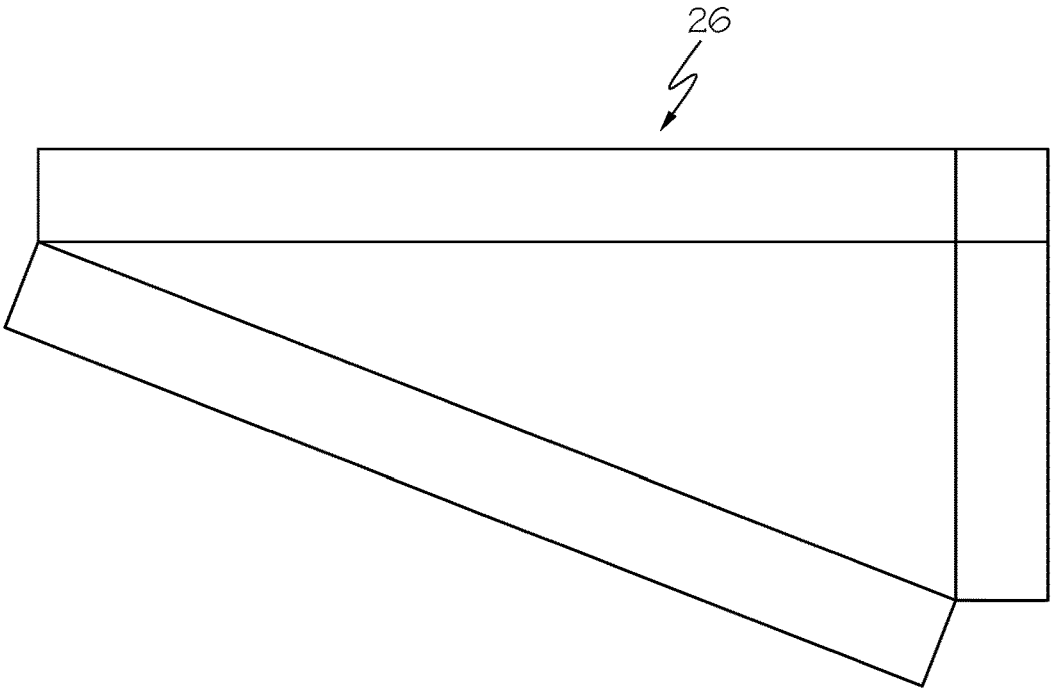
FIG. 13 shows the bend lines to fold a piece of extruded aluminum to form the intermediate support bracket.
Figure 14:
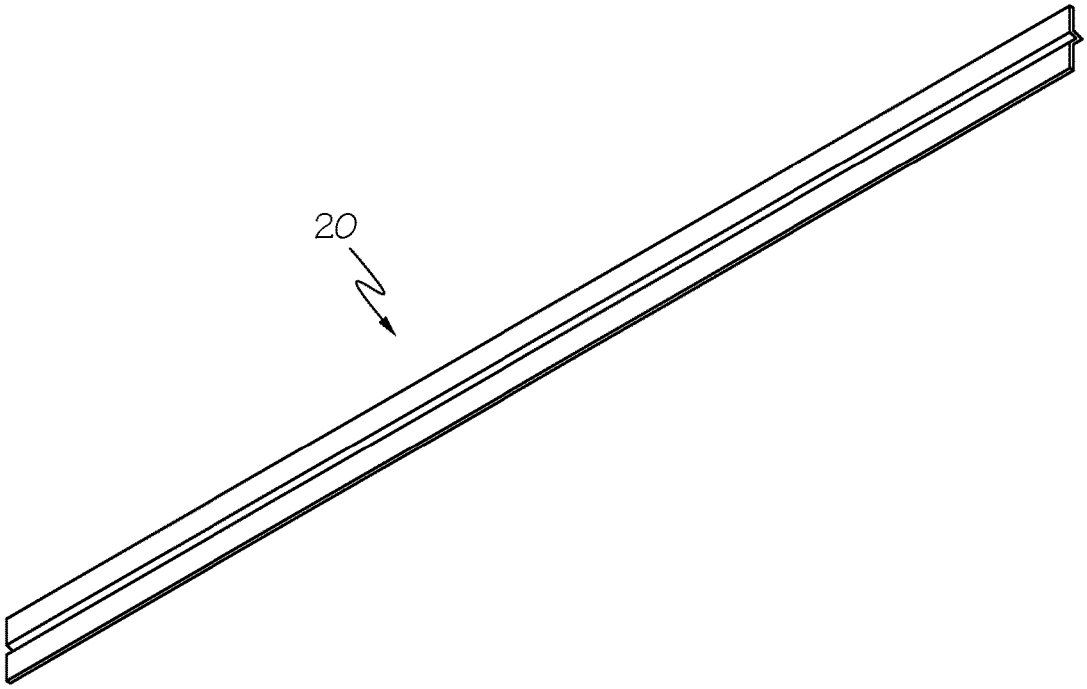
FIG. 14 shows a tread strip.
Figure 15:
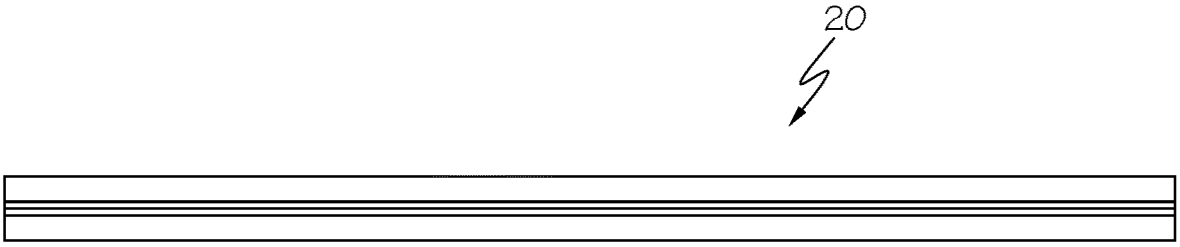
FIG. 15 shows the bend lines to fold a piece of extruded aluminum to form the tread strip.
Figure 16:
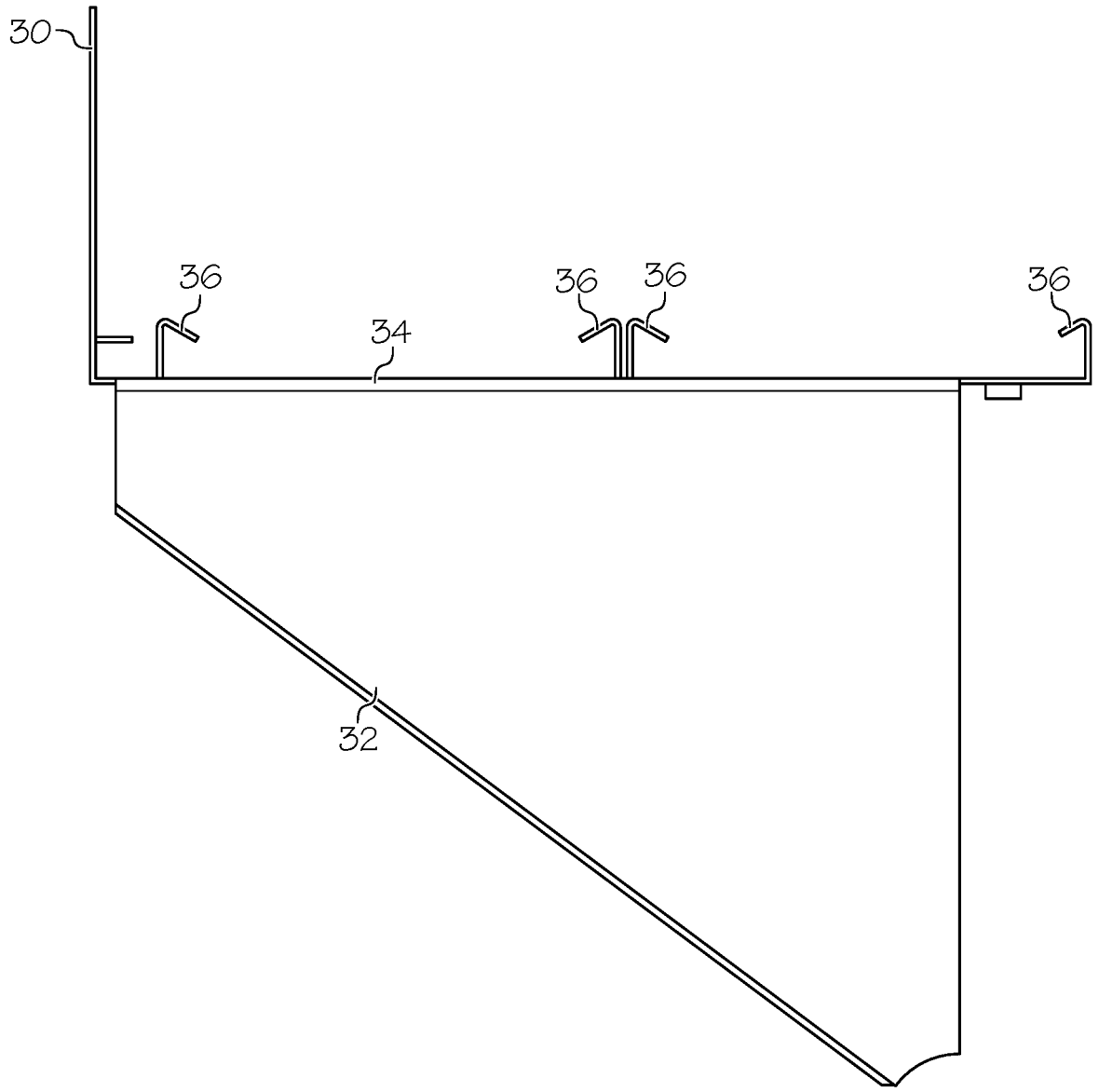
FIG. 16 shows a side view of an alternative embodiment of the inventive stair system.
Figure 17:
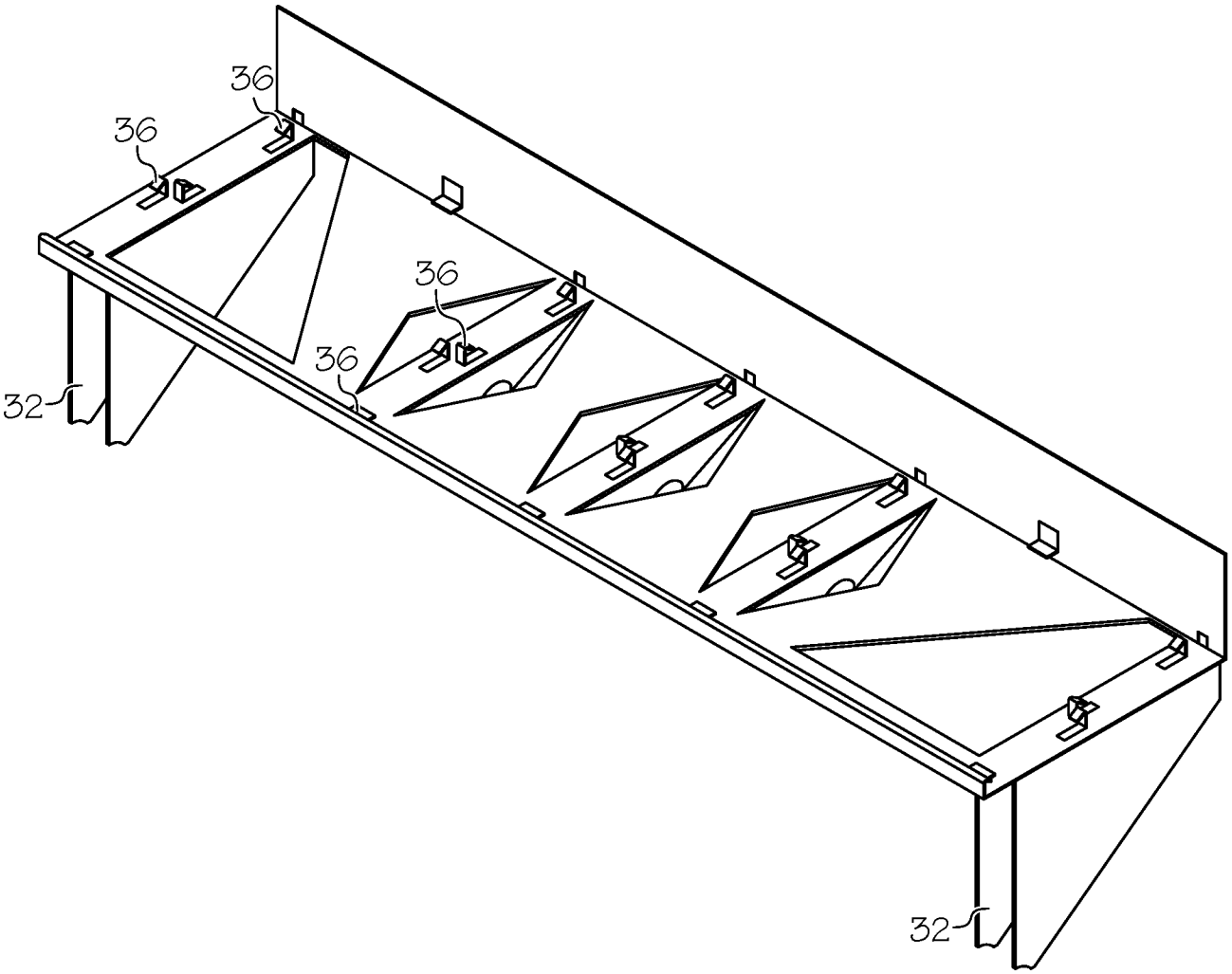
FIG. 17 shows a top perspective view of the alternative embodiment of the inventive stair system.
Figure 18:
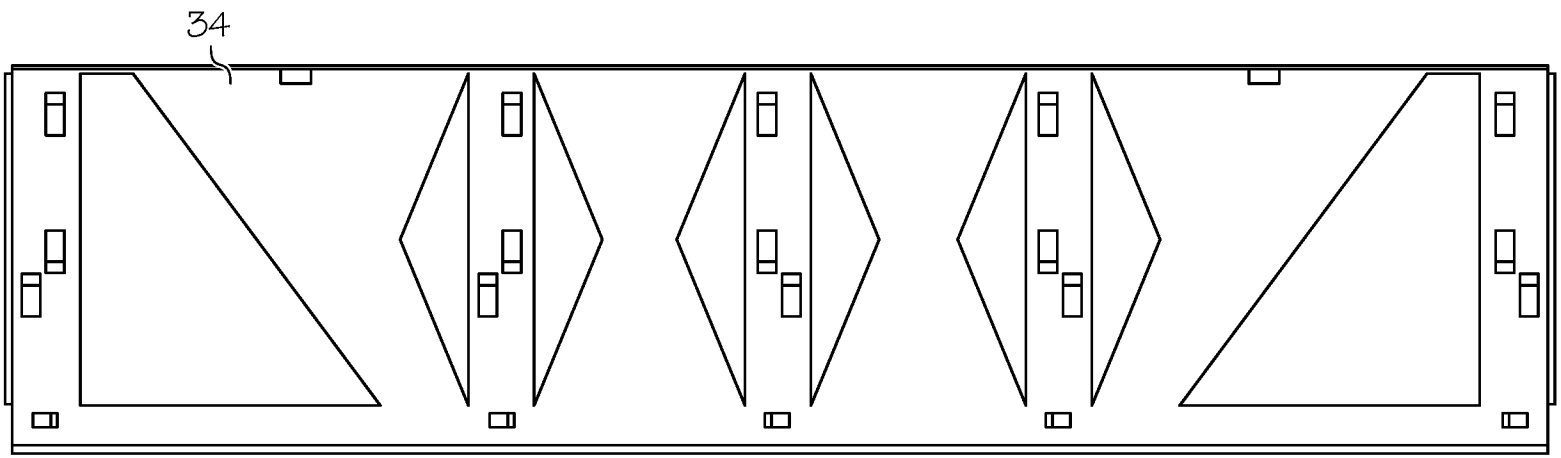
FIG. 18 shows a top view of the alternative embodiment of the inventive stair system.
Figure 19:
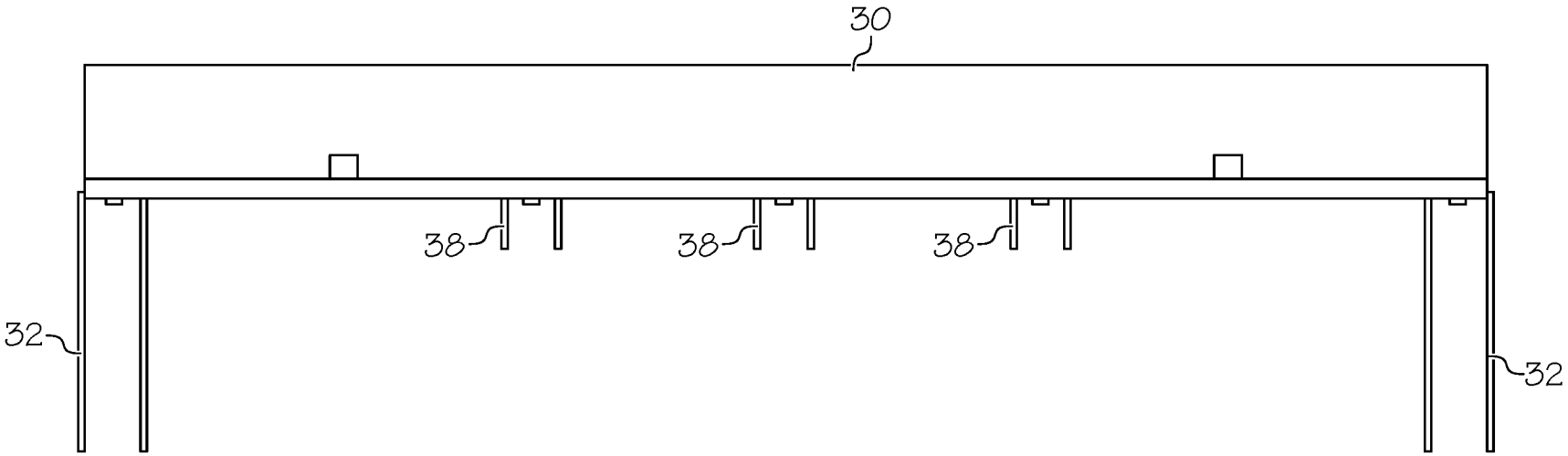
FIG. 19 shows a front view of the of the alternative embodiment of the inventive stair system.

In FIG. 1 and FIG. 2, the deck mounting plate is shown at 12. The deck mounting plate 12, shown in more detail in FIG. 4, is made of mild steel sheet metal or similar cut and bent five times, as shown in FIG. 5 and is attached to a support structure such as deck, porch, patio or similar using off the shelf hardware suitable for to the support structure and component materials. It is also where the third-party stringer beams 14 attach on the up-slope end. The base plate is shown at 16, and is the down-slope end of the stringer beams 14 attachment point and lays on the ground for support of the overall stair system. The base plate 16 is made of mild steel sheet metal or similar material and is shown in more detail in FIG. 6, and is cut and bent three times as shown in FIG. 7. The base plate 16 is attached to the stringer beams 14 and other components using off the shelf hardware suitable to the materials. The treads or deck boards are shown at 18, and are connected using a tread strip shown at 20. The tread bracket is shown at 22, and forms the sides of the steps that attach to the stringer beams 14 and other components using off the shelf hardware suitable to the materials. The tread bracket 22 is made of mild steel sheet metal or similar material and is shown in more detail in FIG. 8, and is cut and bent three times as shown in FIG. 9. The tread assembly is shown at 24 (in FIG. 2) and is the main stair structure and consists of three sheets of mild steel or similar material shown in more detail in FIG. 10, and cut bent and spot welded or held together by other mechanical means as shown in FIG. 11. The tread assembly 24 is attached using off the shelf hardware suitable for the materials and supports decking material 18 being used as the tread. The intermediate support bracket is shown at 26 (in FIG. 2 and shown in silhouette in FIG. 1) and is placed midway between and parallel to the stringer beams 14. The intermediate support bracket 26 provides added rigidity and support to the stairs. If you are creating very wide stairs you can have more than one support bracket evenly spaced between the beams 14. It is attached to the other components using off the shelf hardware suitable to the materials. Intermediate support bracket 26 is made of mild steel or similar sheet metal, is shown in more detail in FIG. 12 and is cut and bent five times as shown in FIG. 13. The tread strip 20 is placed in between the decking boards 18, is shown in more detail in FIG. 14 and is made of mild steel or similar material cut and bent three times as shown in FIG. 15.

To assemble the inventive stair system, first the base plate 16 and deck mounting plate 12 are attached to two 3$^{rd}$ party stringer beams 14 using off the shelf hardware appropriate to the support structure and beam materials to create the main support frame. Next, the modular stair assemblies are put together from the modular parts consisting of a tread bracket 22, tread assembly 24, intermediate support bracket 26, tread strip 20 and 3$^{rd}$ party decking material 18 of your choice. These components are secured together then secured to the beams 14 all using off the shelf hardware suitable to the decking, beam and component materials.

While the modular components of the inventive stair system are described herein as made of mild steel, they can be made of any desired material, such as aluminum or could be made of a composite material, alloy, PVC or other plastic material if desired.

Referring now to FIGS. 16-19, an alternative embodiment of the inventive stair system is shown which integrally combines the tread bracket 22, the tread assembly 24, the intermediate support bracket 26 and the tread strip 20 into a single integral assembly which reduces the number of pieces per tread and also builds decking fasteners into the tread to eliminate the use of screws to fasten decking. The decking 18 slides into place. Aesthetically this version reduces the amount of visible metal after assembly.

In this embodiment, the back of the tread assembly is shown at 30, the tread bracket is shown at 32, the bottom of the tread assembly is shown at 34 and the decking securing devices are shown at 36, which hold the decking 18 in place. The integrally formed intermediate support brackets are shown at 38.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of making a stair system comprising the steps of:

attaching a deck plate to an existing structure and to the top end of a pair of stringer beams;

attaching a base plate to the bottom end of the pair of stringer beams and lays on the ground for support of the overall stair system;

attaching a pair of tread brackets, which are the sides of a step that attach to the stringer beams;

attaching a plurality of steps to the pair of stringer beams, the steps being comprised of a tread assembly, a pair of tread brackets and at least one intermediate support bracket, wherein each tread assembly is comprised of three sheets of mild steel cut bent and spot welded, and attached to the stringer beams;

further including the step of placing the intermediate support bracket midway between and parallel to the stringer beams, to provide added rigidity and support to the stairs, and placing a plurality of tread strips, each placed between decking boards which are attached to the step tread assemblies.

2. The method of making the stair system of claim 1 further including the step of attaching decking material to the steps.

3. The method of making the stair system of claim 1 wherein the plurality of steps is integrally formed.

4. The method of making the stair system of claim 1 wherein the plurality of steps is made of modular components which are connected to each other.

5. The method of making the stair system of claim 1 wherein the deck plate, base plate and plurality of steps are made of metal.

6. A stair system comprising:

a deck plate attached to an existing structure;

a pair of stringer beams attached to the existing structure and the deck plate;

a base plate is attached to the bottom of the stringer beams and lays on the ground for support of the overall stair system;

a pair of tread brackets, which are the sides of a step that attach to the stringer beams;

a plurality of step tread assemblies, each of which is comprised of three sheets of mild steel cut bent and spot welded, and attached to the stringer beams;

an intermediate support bracket, which is placed midway between and parallel to the stringer beams and provides added rigidity and support to the stairs, and a plurality of tread strips, each placed between decking boards which are attached to the step tread assemblies.

7. The stair system of claim 6 wherein the tread assemblies, tread brackets and intermediate support brackets are integrally formed.

8. The stair system of claim 6 wherein the deck plate, base plate, tread assemblies, tread brackets and intermediate support brackets are made of metal.

* * * * *